US009273516B2

(12) United States Patent
Jones et al.

(10) Patent No.: US 9,273,516 B2
(45) Date of Patent: Mar. 1, 2016

(54) FLUID CONVEYED THRUSTER

(71) Applicants: Kevin Dewayne Jones, Clinton, OK (US); Phillip Dwayne Shepard, II, Carter, OK (US)

(72) Inventors: Kevin Dewayne Jones, Clinton, OK (US); Phillip Dwayne Shepard, II, Carter, OK (US)

( * ) Notice: Subject to any disclaimer, the term of this patent is extended or adjusted under 35 U.S.C. 154(b) by 393 days.

(21) Appl. No.: 13/775,401

(22) Filed: Feb. 25, 2013

(65) Prior Publication Data

US 2013/0220702 A1 Aug. 29, 2013

Related U.S. Application Data

(60) Provisional application No. 61/604,577, filed on Feb. 29, 2012.

(51) Int. Cl.
*E21B 4/18* (2006.01)
*E21B 23/10* (2006.01)

(52) U.S. Cl.
CPC .. *E21B 4/18* (2013.01); *E21B 23/10* (2013.01)

(58) Field of Classification Search
CPC ..... E21B 23/10; E21B 4/18
USPC ..... 175/73
See application file for complete search history.

(56) References Cited

U.S. PATENT DOCUMENTS 5,165,438 A * 11/1992 Facteau et al. ..... 137/1
5,455,804 A * 10/1995 Holmes et al. ..... 367/83
5,893,383 A * 4/1999 Facteau ..... 137/14
6,719,048 B1 * 4/2004 Ramos et al. ..... 166/250.15
6,976,507 B1 * 12/2005 Webb et al. ..... 137/826
7,481,119 B2 * 1/2009 Yang et al. ..... 73/861.19
8,863,835 B2 * 10/2014 Schultz et al. ..... 166/244.1
2005/0214147 A1 * 9/2005 Schultz et al. ..... 417/503
2011/0186300 A1 * 8/2011 Dykstra et al. ..... 166/316
2012/0167994 A1 * 7/2012 Schultz et al. ..... 137/12
2012/0291539 A1 11/2012 Schultz et al.
2012/0292015 A1 11/2012 Schultz et al.
2012/0292016 A1 11/2012 Schultz et al.
2012/0292017 A1 11/2012 Schultz et al.
2012/0292018 A1 11/2012 Schultz et al.
2012/0292019 A1 11/2012 Schultz et al.
2012/0292020 A1 11/2012 Schultz et al.
2012/0292033 A1 11/2012 Schultz et al.
2012/0292113 A1 11/2012 Schultz et al.
2012/0292116 A1 11/2012 Schultz et al.

* cited by examiner

*Primary Examiner* — Benjamin Fiorello

(74) *Attorney, Agent, or Firm* — Tomlinson Rust McKinstry Grable

(57) ABSTRACT

A fluid conveyed thruster for use in combination with a bottom hole assembly connected to a drill string during drilling operations. The fluid conveyed thruster comprises a continuous passage comprising a narrowed portion and an intersection. Fluid passing through the continuous passage of the fluid conveyed thruster accelerates as it passes through the narrowed portion and the intersection. The acceleration of fluid exiting the fluid conveyed thruster urges the tool forward and in turn urges the bottom hole assembly forward within a wellbore. The fluid conveyed thruster extends the reach of the bottom hole assembly and the drill string within the wellbore.

22 Claims, 4 Drawing Sheets

FLUID CONVEYED THRUSTER

CROSS REFERENCE TO RELATED APPLICATION

This application claims the benefit of provisional patent application Ser. No. 61/604,577 filed on Feb. 29, 2012, the entire contents of which are incorporated herein by reference.

FIELD OF THE INVENTION

The present invention relates to downhole tools used with bottom hole assemblies during underground drilling operations; specifically, the present invention relates to downhole tools used for facilitating the insertion of a bottom hole assembly into a wellbore.

SUMMARY OF THE INVENTION

The present invention is directed to a bottom hole assembly. The bottom hole assembly comprises a rod member. The rod member comprises a continuous passage formed in a center of the rod member. The continuous passage comprises an intersection wherein fluid passing through the continuous passage is accelerated proximate the intersection to urge the bottom hole assembly forward.

The present invention is also directed to a method for running a drill string with a bottom hole assembly into a borehole. The bottom hole assembly comprises a continuous passage comprising a first forward flowing section, a second forward flowing section, a rearward flowing section, and an intersection. The method comprises placing the drill string with the bottom hole assembly into the borehole, passing a fluid through the continuous passage of the bottom hole assembly, accelerating the fluid at the intersection of the continuous passage, and advancing the bottom hole assembly and the drill string forward.

The present invention is further directed to a fluid conveyed thruster for facilitating the insertion of a bottom hole assembly into a wellbore. The fluid conveyed thruster comprises a rod member. The rod member comprises a first half comprising a continuous groove, wherein the continuous groove comprises an intersection, and a second half. The continuous groove forms a continuous passage when the first half and the second half are joined. Fluid is capable of flowing through the continuous passage as to cause the fluid conveyed thruster to advance the bottom hole assembly forward within the wellbore.

DESCRIPTION OF THE INVENTION

In oil and gas drilling operations, it may become difficult to advance a bottom hole assembly forward in the wellbore, particularly when gravity is not available to pull the bottom hole assembly or causes friction between the wellbore wall and the bottom hole assembly such as in horizontal drilling operations. The present invention, a fluid conveyed thruster, is a fluid powered tool that may be used in combination with a bottom hole assembly to help urge the bottom hole assembly forward within the wellbore and extend the reach of a drill string. The device works by converting fluid flowing from the drill string and into the device into pressurized fluid. The device then sends pressurized fluid into the wellbore surrounding the bottom hole assembly. The pressurized fluid works to reduce the friction within the bottom hole assembly allowing the bottom hole assembly to move farther forward within the wellbore. The apparatus can work with a bottom hole assembly of any number of configurations, particularly with bottom hole assemblies ran on coil tubing, stickpipe, or drill pipe.

Figure 1:
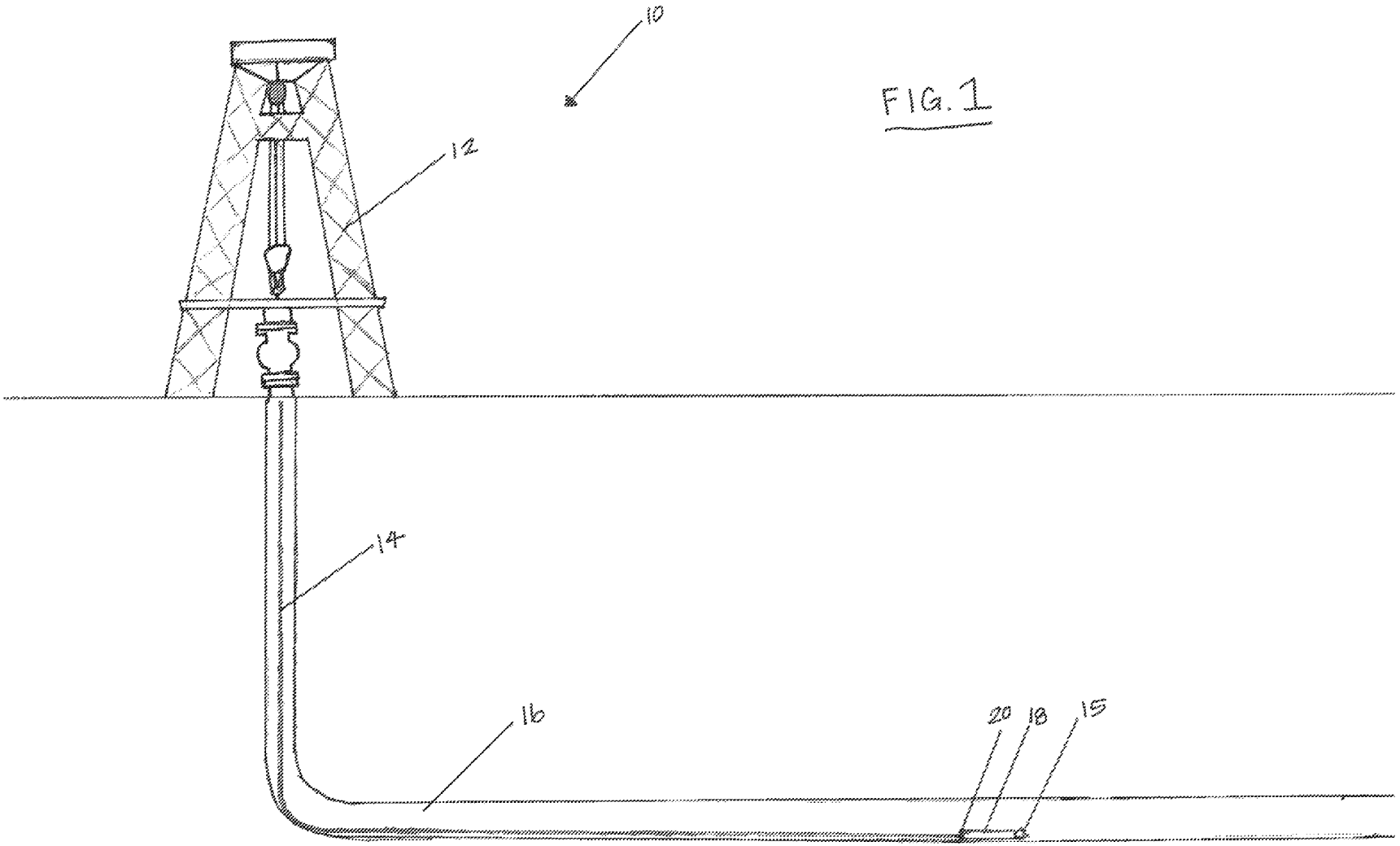
FIG. 1 is a diagrammatic illustration of a drilling system having a bottom hole assembly.

Turning to the figures, FIG. 1 shows a drilling system 10. The drilling system 10 comprises surface equipment 12, a drill string 14, and a drill bit 15. The drill string 14 may comprise coiled tubing, stickpipe, or drill pipe. The drilling system 10 works to advance the drill string 14 and the drill bit 15 down a wellbore 16 during drilling operations. A bottom hole assembly 18 is connected to a terminal end 20 of the drill string 14. The bottom hole assembly 18 may comprises a variety of tools used for drilling operations. The bottom hole assembly 18 may comprise multiple tools, such as mud motors, telemetry equipment, hammers, etc., or the bottom hole assembly may just comprise one tool depending on what type of tools are needed at the different stages of drilling operations.

Figure 2:
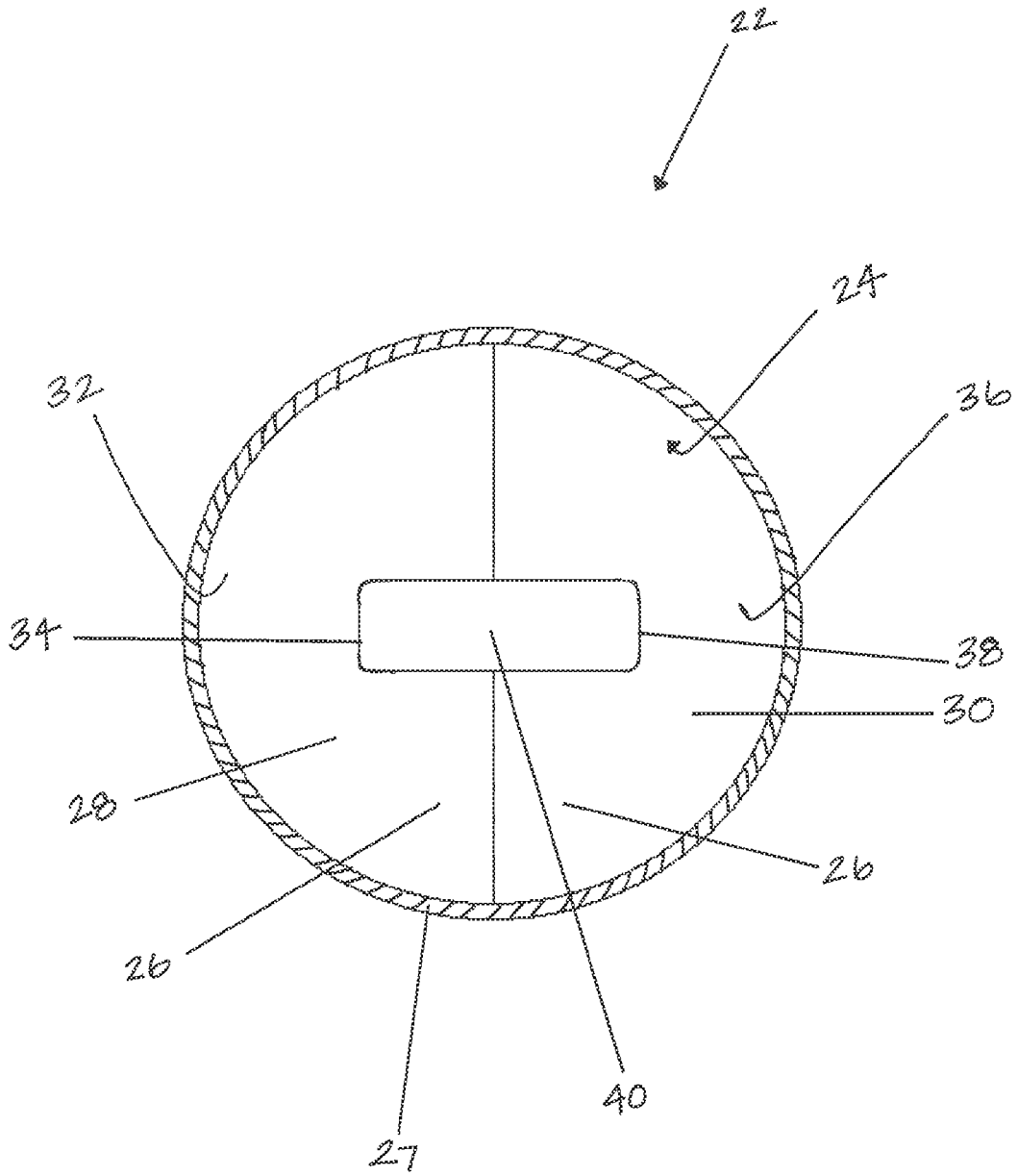
FIG. 2 is and end view of a fluid conveyed thruster used to assist insertion of the bottom hole assembly of FIG. 1 into a wellbore.

With reference to FIG. 2, an end view of a fluid conveyed thruster 22 of the present invention is shown. FIG. 2 shows a top end 24 of the fluid conveyed thruster. The fluid conveyed thruster 22 similarly comprises a bottom end (not shown). The fluid conveyed thruster 22 comprises a solid rod member 26. The solid rod member comprises a first half 28 and a second half 30. The first half 28 comprises a top end 32 and a first continuous groove 34. The second half 30 comprises a top end 36 and a second continuous groove 38. As shown, the first continuous groove 34 and the second continuous groove 38 are mirror images of each other such that when the first half 28 and the second half 30 are placed together, the first continuous groove 34 and the second continuous groove 38 match up with each other and form a continuous passage 40. The continuous passage 40 may form any number of shapes, such as a cylinder or a rectangle. While the continuous passage 40 is shown in FIG. 2 as being formed by the first continuous groove 34 and second continuous groove 38, one skilled in the art will appreciate the continuous passage may be formed in one half of the solid rod member 26 alone. The solid rod member 26 may slide into a sleeve 27 which holds the first half 28 and second half 30 flush together when operating.

Figure 3:
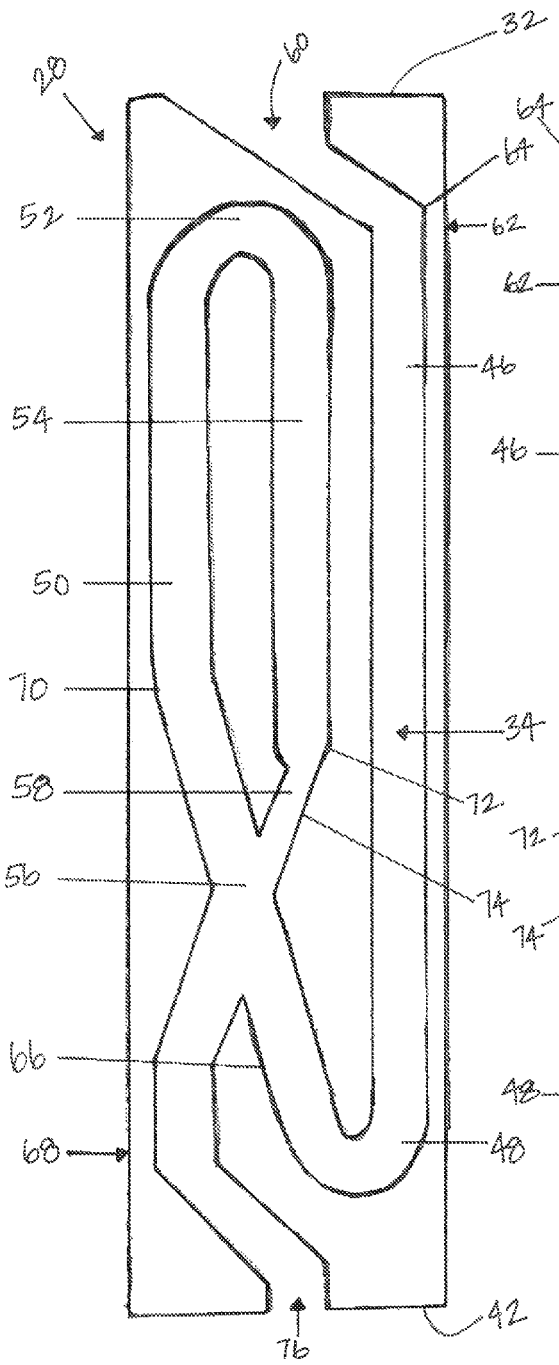
FIG. 3 is a side view of a first half of the fluid conveyed thruster.
Figure 4:
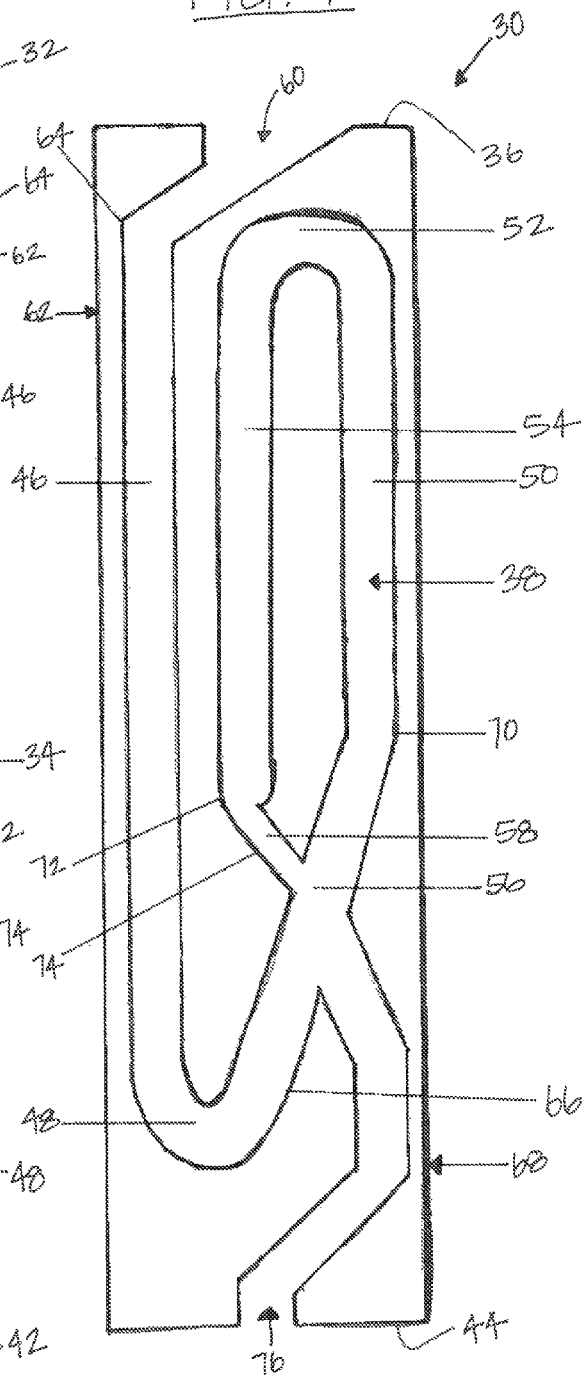
FIG. 4 is a side view of a second half of the fluid conveyed thruster.
Figure 5:
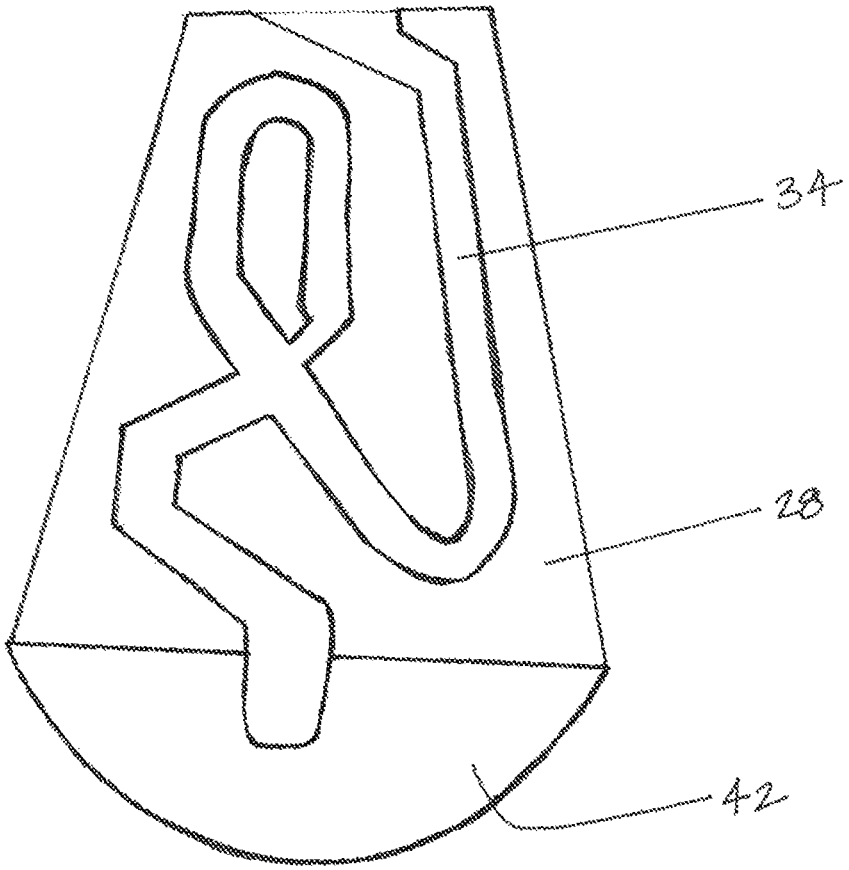
FIG. 5 is a perspective view of the first half of the fluid conveyed thruster.

Turning to FIGS. 3 and 4, a side view of the first half 28 and the second half 30 is shown. The top end 32 of the first half 28 is shown in FIG. 3. The first half 28 also comprises the bottom end 42. The bottom end 42 is also shown in FIG. 5. The top end 36 of the second half is shown in FIG. 4. The second half 30 also comprises a bottom end 44. The first continuous groove 34 starts at the top end 32 and ends at the bottom end 42 of the first half 28. Similarly, the second continuous groove 38 starts at the top end 36 and ends at the bottom end 44 of the second half 30. The continuous passage 34 and each continuous groove 34, 38 comprises an asymmetrical path that has no axis of longitudinal symmetry.

Since the first continuous groove 34 and the second continuous groove 38 are mirror images of each other, the specifics of the grooves 34 and 38 will be described together. The first continuous groove 34 and the second continuous groove 38 comprise a first section 46, a first bend 48, a second section 50, a second bend 52, and a third section 54. The first section 46 meets the second section 50 at the first bend 48. The second section 50 meets the third section 54 at the second bend 52. The third section 54 intersects the second section 50 at an intersection 56. The intersection 56 is between the second section 50 and the third section 54 and between the first bend 48 and the second bend 52. The width of the third section 54 is narrower prior to the intersection 56 forming a narrowed portion 58.

Continuing with FIGS. 3 and 4, the first continuous groove 34 and the second continuous groove 38 begin at an entry port 60 and extend diagonally toward a first edge of the tool 62. The grooves 34 and 38 have an elbow 64 that transitions into the first section 46. The first section 46 runs the length of the tool 22 towards the bottom ends 42 and 44. The first section 46 ends at the first bend 48 that turns the grooves 34 and 38 to a first diagonal 66 that extends away from the first section 46 towards a second edge of the tool 68 and towards the top ends 32 and 36. A slight bend 70 in the grooves 34 and 38 transitions the first diagonal 66 to the second section 50. The second section 50 runs the length of the tool 22 and ends in a hairpin turn or the second bend 52 proximate the top ends 32 and 36 and transitions to the third section 54. Approximately halfway down the tool 22, the third section 54 narrows and forms a second elbow 72 which forms a second diagonal 74. The second diagonal 74 intersects with the first diagonal 66 forming the intersection 56. The grooves 34 and 38 then angle back towards the center of the tool 22 and terminate at an exit port 76. One skilled in the art will appreciate that the precise path of the sections 46, 50, 54 may vary without departing from the principles contained herein.

In operation, the first half 28 and the second half 30 are placed together such that the continuous passage 40 comprises a combination of the first continuous groove 34 and the second continuous groove 38. During drilling operations, fluid is sent into the drill string 14 via the surface equipment 12. Fluid flows through the drill string 14 towards the drill bit 15 and the downhole tool or tools making up the bottom hole assembly 18. The fluid conveyed thruster 22 is a fluid powered downhole tool that operates via fluid flowing from the drill string 14 into the tool. The fluid conveyed thruster 22 converts fluid from the drill string 14 into pressurized fluid. Fluid enters the entry port 60 and passes through the elbow 64 and into the first section 46. Fluid travels through the first section 46, around the bend 48, through the first diagonal 66 and the intersection 56. Fluid then passes through the slight bend 70 and into the second section 50. Fluid then passes through the section 50, around the second bend 52, and into the third section 54. Fluid then turns at the second elbow 72 and enters the narrowed portion 58 or the second diagonal 74. Fluid next passes back through the intersection 56 and curves back towards the centers of the tool. Fluid finally exits the tool 22 at the exit port 76 at the bottom end of the tool. The bottom end (not shown) is formed from the combination of bottom end 42 of the first half 28 and the bottom end 44 of the second half 30.

When the fluid encounters the narrowed portion 58 of the continuous passage 40, the velocity of the fluid is increased, increasing the force at which the fluid is exerted through the intersection 56 and out of the bottom end of the tool. This flow scheme increases the effectiveness of fluid pushed past the bottom hole assembly 18, and reduces the friction within the bottom hole assembly 18. The pressurized fluid exiting the tool 22 caused by this flow scheme also reduces the friction between the bottom hole assembly 18 and the wellbore 16 which in turn urges the bottom hole assembly 18 further down the wellbore 16. The pressurized fluid created by the fluid conveyed thruster 22 also clears any debris in the wellbore 16 out of the path of the bottom hole assembly 18.

The fluid conveyed thruster 22 is configured such that it contains no moving parts. The lack of moving parts reduces the amount of movement of the fluid conveyed thruster 22 when large amounts of fluid are pumped through the device. The lack of moving parts also increases the ease of manufacturing and the stability of the fluid conveyed thruster 22. Therefore, the fluid conveyed thruster 22 is capable of operating with a variety of fluid flow rates without fatiguing or clogging. The configuration of the fluid conveyed thruster 22 is also not affected by a change of temperature or presence of nitrogen.

While the figures show a continuous passage formed by two corresponding grooves, the continuous passage may also be formed by only one groove in combination with a solid surface. In addition, the continuous passage may also be formed in a solid rod member that does not comprise two halves.

Although the preferred embodiment has been described in detail, it should be understood that various changes, substitutions and alterations can be made therein without departing from the spirit and scope of the invention as defined by the appended claims.

What is claimed is:

1. A bottom hole assembly comprising:
- a rod member comprising:
  - a top end;
  - a bottom end; and
  - a continuous, asymmetrical passage formed in a center of the rod member, the continuous passage comprising:
    - an entry point disposed on the top end of the rod member;
    - an exit port disposed on the bottom end of the rod member; and
    - an intersection formed within the continuous asymmetrical passage;
    - wherein fluid passing through the continuous asymmetrical passage is accelerated proximate the intersection to urge the bottom hole assembly forward.

2. The bottom hole assembly of claim 1 wherein the rod member further comprises a first half and a second half.

3. The bottom hole assembly of claim 2 wherein the first half defines a first continuous groove and the second half defines a second continuous groove.

4. The bottom hole assembly of claim 3 wherein the first continuous groove and the second continuous groove form the continuous asymmetrical passage when the first half and the second half of the member are placed together.

5. The bottom hole assembly of claim 1 wherein the continuous asymmetrical passage comprises a first bend, a second bend, a first section, a second section, and a third section, wherein the first section meets the second section at the first bend and the second section meets the third section at the second bend.

6. The bottom hole assembly of claim 5 wherein the intersection is between the second section and the third section.

7. The bottom hole assembly of claim 6 wherein the width of the third section is narrower prior to the intersection.

8. The bottom hole assembly of claim 1 wherein the continuous asymmetrical passage is cylindrical.

9. The bottom hole assembly of claim 1 wherein the continuous asymmetrical passage is rectangular.

10. A method for running a drill string with a bottom hole assembly into a borehole, the bottom hole assembly comprising a top end, a bottom end, and a continuous asymmetrical passage and an intersection, the method comprising:

placing the drill string with the bottom hole assembly into the borehole;

passing a fluid through the top end of the bottom hole assembly and into the continuous asymmetrical passage;

accelerating the fluid by passing the fluid through the intersection of the continuous asymmetrical passage; and advancing the bottom hole assembly and the drill string forward by passing the fluid through the bottom end of the bottom hole assembly.

11. The method of claim 10 further comprising the step of passing the fluid through a first bend in the continuous asymmetrical passage and through a second bend in the continuous asymmetrical passage.

12. The method of claim 10 further comprising the step of passing the fluid through a narrowed portion of the continuous asymmetrical passage prior to passing the fluid through the intersection of the continuous asymmetrical passage.

13. The method of claim 10 further comprising the step of passing fluid through the drill string and into the bottom hole assembly.

14. A fluid conveyed thruster for facilitating the insertion of a bottom hole assembly into a wellbore, the fluid conveyed thruster comprising:

a rod member, the rod member comprising:

a top end, a bottom end, a first half comprising a continuous groove, wherein the continuous groove comprises an intersection; and a second half, wherein the continuous groove forms a continuous asymmetrical passage when the first half and the second half are joined; and wherein a fluid passes through the entry point disposed on the top end of rod member, into the continuous asymmetrical passage, through the intersection, and out the exit port disposed on the bottom end of the rod member to cause the fluid conveyed thruster to advance the bottom hole assembly forward within the wellbore.

15. The fluid conveyed thruster of claim 14 wherein the second half comprises a continuous groove.

16. The fluid conveyed thruster of claim 15 wherein the continuous groove of the second half comprises an intersection.

17. The fluid conveyed thruster of claim 15 wherein the continuous groove of the second half forms a continuous asymmetrical passage when the first half and the second half are joined.

18. The fluid conveyed thruster of claim 14 wherein the continuous asymmetrical passage comprises a first bend, a second bend, a first section, a second section, and a third section, wherein the first section meets the second section at the first bend and the second section meets the third section at the second bend.

19. The fluid conveyed thruster of claim 18 wherein the intersection is between the second section and the third section.

20. The fluid conveyed thruster of claim 19 wherein the width of the third section is narrower prior to the intersection.

21. The fluid conveyed thruster of claim 14 wherein the continuous asymmetrical passage is cylindrical.

22. The fluid conveyed thruster of claim 14 wherein the continuous asymmetrical passage is rectangular.

* * * * *